US007033440B2

(12) United States Patent
Sieweke

(10) Patent No.: US 7,033,440 B2
(45) Date of Patent: Apr. 25, 2006

(54) ADHESIVE TRANSFER ROLLER OF AN ADHESIVE APPLICATION DEVICE

(75) Inventor: Peter Sieweke, Bielefeld (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/836,238

(22) Filed: May 3, 2004

(65) Prior Publication Data

US 2005/0000415 A1 Jan. 6, 2005

(30) Foreign Application Priority Data

May 2, 2003 (DE) ..... 103 19 658

(51) Int. Cl.
*B05C 1/08* (2006.01)

(52) U.S. Cl. ..... 118/200; 118/209; 118/DIG. 14; 118/DIG. 15; 156/578

(58) Field of Classification Search ..... 118/200, 118/209, DIG. 14, DIG. 15; 427/428, 428.12, 427/428.15; 101/216, 217, 375; 384/537; 156/578

See application file for complete search history.

(56) References Cited

U.S. PATENT DOCUMENTS 5,092,242 A * 3/1992 Knauer ..... 101/248
6,063,016 A 5/2000 Maiwald et al.

FOREIGN PATENT DOCUMENTS

| | | |
|---|---|---|
| DE | GM 75 38 002 | 4/1976 |
| DE | 44 23 803 C2 | 7/1994 |
| DE | 197 33 446 A1 | 8/1997 |
| EP | 195 28 217 A1 | 8/1995 |

* cited by examiner

*Primary Examiner*—Laura Edwards
(74) *Attorney, Agent, or Firm*—Jacobson Holman PLLC

(57) ABSTRACT

An adhesive application device, preferably in a tube extruding machine, for transferring adhesive to a sizing roller using an adhesive transfer roller that is mounted with bearings in lever arms so that it can rotate. The adhesive transfer roller can be moved toward and away from the sizing roller using the lever arms which are mounted so that they can rotate in the machine frame. The bearings, with which the adhesive transfer roller is mounted in the lever arms are accessible from the outside of the machine frame side walls so that the bearings can be replaced without removing the transfer roller from its position between the side walls.

16 Claims, 2 Drawing Sheets

Prior Art

ADHESIVE TRANSFER ROLLER OF AN ADHESIVE APPLICATION DEVICE

BACKGROUND OF THE INVENTION

1. Field of the Invention

The present invention relates to an adhesive transfer roller of an adhesive application device, preferably in a tube extruding machine.

2. Description of the Invention

In known adhesive application devices in tube extruding machines, as shown for example in EP 0 546 286 B1, adhesive transfer rollers are frequently used, which form an adhesive slot with at least one other roller (frequently a sealing roller). To the sides of the rollers, sealing plates are arranged, which create a pan into which the adhesive is poured. The adhesive transfer roller has a direction of rotation such that it picks up adhesive through the slot and transfers it to a sizing roller.

The adhesive transfer rollers of the known adhesive application devices are mounted with bearings in lever arms so that they can rotate. These lever arms are used to move the adhesive transfer roller toward and away from the sizing roller. For this purpose, the lever arms are mounted on the inside on the side walls of the machine frame.

Since in spite of the sealing plates at the face sides of the rollers, escape of adhesive can not be prevented completely, adhesive gets into the bearings used to mount the adhesive transfer roller in the lever arms. Because of this it is necessary to replace the bearings frequently. However, what has proven to be disadvantageous is that in order to replace the bearings, the adhesive transfer roller has to be removed from the area between the side walls of the machine frame.

SUMMARY OF THE INVENTION

The object of the present invention is thus to suggest an adhesive transfer roller that does not have to be removed from the machine frame for the purpose of replacing the bearing.

According to the invention, this object is achieved by the characteristics of the identifying part of claim 1.

According to the present invention, this object is achieved by an adhesive application apparatus having an adhesive transfer roller for transferring adhesive to a sizing roller. The adhesive transfer roller is mounted with bearings in lever arms which can be used to move the adhesive transfer roller toward and away from the sizing roller. The lever arms are mounted so that they can rotate in the machine frame. beyond the side walls of which the adhesive transfer roller extends. The bearings, with which the adhesive transfer roller is mounted in the lever arms. are accessible from the outside of the machine frame side walls.

Because the bearings are mounted in the lever arms so as to be accessible from the outside of the side walls of the machine frame, the bearings can be pulled from the face-side bearing neck of the adhesive transfer roller from the outside. During bearing replacement, the adhesive transfer roller can be supported in the holes in the side walls of the machine frame or on special brackets.

It is especially advantageous here if at least one of the lever arms is mounted on the side of the machine frame side wall that holds the lever arm that is turned away from the adhesive transfer roller. In this case, all that has to be removed is the fastener with which the lever arm is fastened in the side wall. Then the entire lever arm, including the bearing, can be pulled from the adhesive transfer roller neck and the bearing can be replaced.

In a preferred embodiment of the invention, on at least one face-side end, the adhesive transfer roller comprises a neck that is mounted so that it can be removed, with which the adhesive transfer roller is mounted in one of the lever arms. In this embodiment, the lever arm can be mounted on the inside on the side wall that holds it. The adhesive transfer roller neck can be removed through a hole in the side wall so that the bearing is freely accessible. Since the neck and the bearing usually have a very tight connection, the neck and the bearing can be removed simultaneously and separated from each other elsewhere.

It is especially advantageous here if the neck is fastened to the face-side end of the adhesive transfer roller with a screw.

An embodiment example of the invention can be found in the drawings and the objective description. However, it should be mentioned that the invention does not have to be restricted only to a adhesive transfer roller of an adhesive application device but can be extended to all rollers in adhesive application devices that are mounted through side walls of a machine frame.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
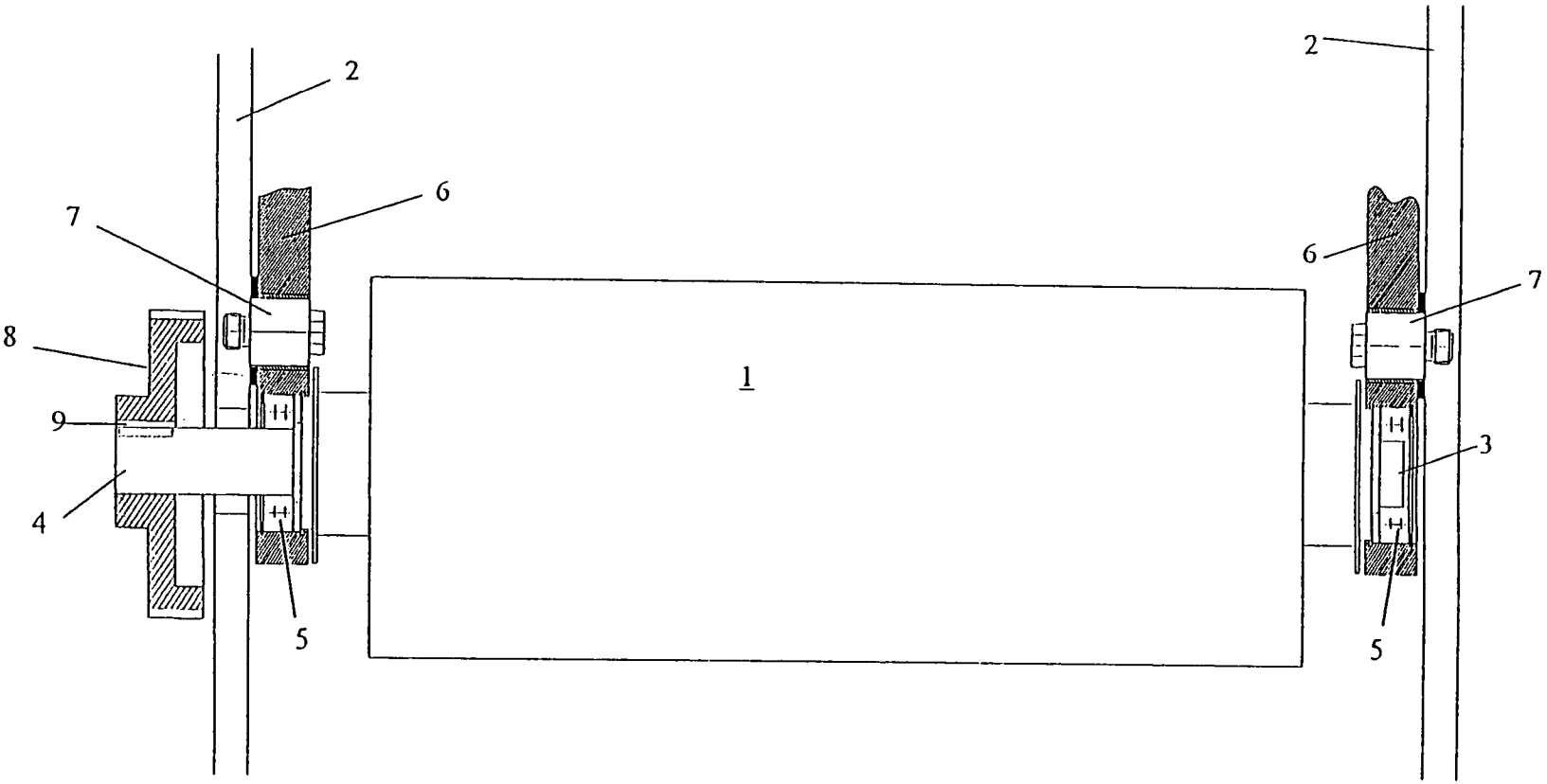
FIG. 1 shows a top view of a adhesive transfer roller according to the state of the art

FIG. 1 shows an adhesive transfer roller 1 that runs crosswise between two side walls 2 of a machine frame. The face-side bearing necks 3, 4 of the adhesive transfer roller 1 are mounted in the lever arms 6 by way of bearings 5. The lever arms 6 are mounted on bearing pins 7 that can be screwed into the insides of side walls 2 so that the adhesive transfer roller 1 can be swiveled. The bearing neck 4 of the adhesive transfer roller 1 passes through a hole in one of the side walls 2 of the machine frame. On this bearing neck 4, a drive gear 8 is mounted, with form fit, by means of a spring key 9 so that the drive gear 8 that is moved in rotation by a pulling means, say a toothed belt, can transfer a torque to the adhesive transfer roller 1. If the bearings 5 will now be replaced, first the drive gear 8 has to be removed. Then the bearing pins 7 are removed. After that, the adhesive transfer roller 1, together with the lever arms 6, can be removed from the area between side walls 2. Only then are the bearings 5 accessible.

Figure 2:
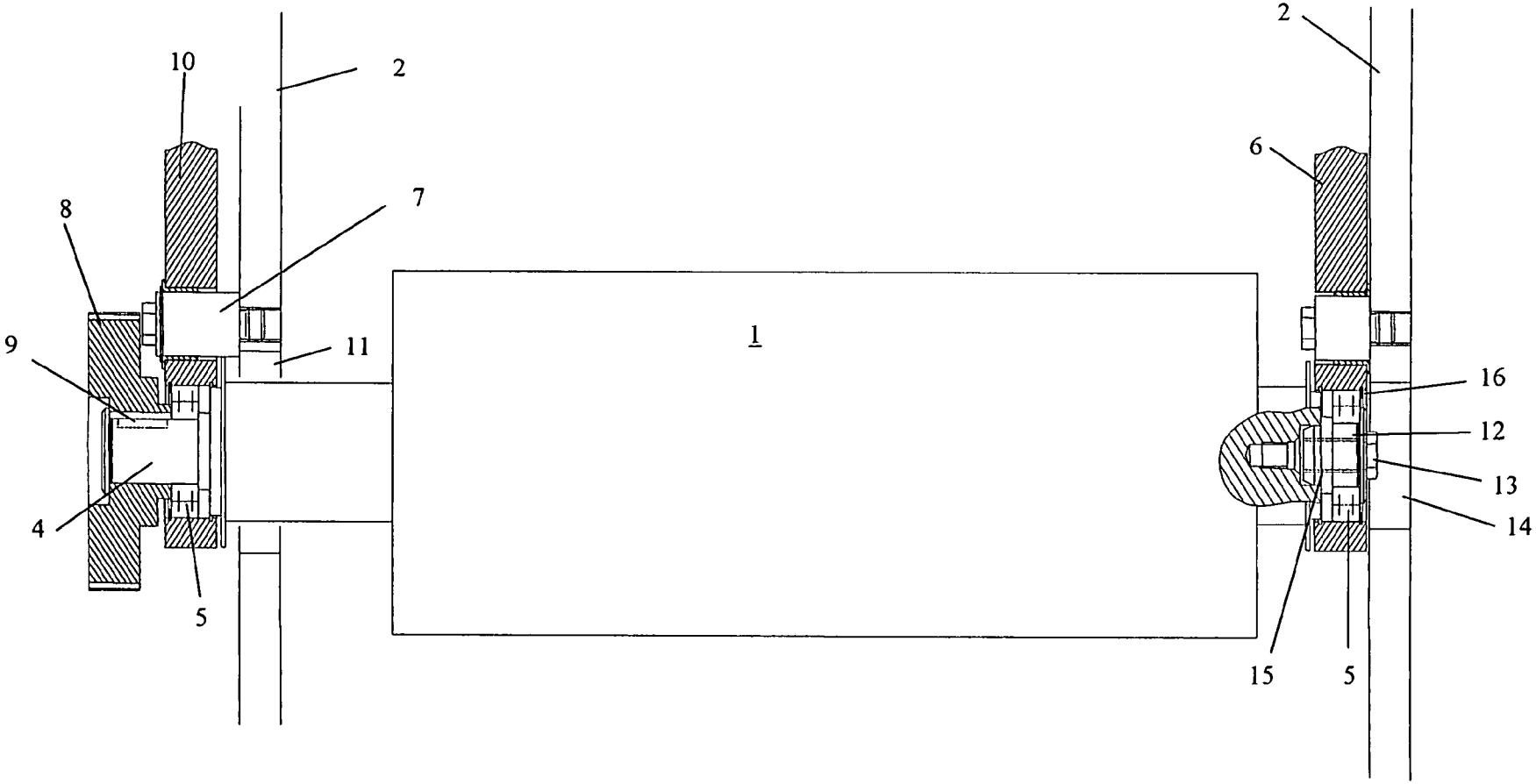
FIG. 2 shows an adhesive transfer roller according to the invention.

FIG. 2 also shows a adhesive transfer roller 1 that runs crosswise between two side walls 2 of a machine frame. The bearing neck 4 of the adhesive transfer roller 1 is mounted in lever arm 10.

Lever arm 10 is mounted on the outside on side wall 2. On the end of the bearing neck 4, drive gear 8 is mounted in a known way using a spring key 9. To replace the bearing 5, first the drive gear 8 has to be removed. Then the bearing pin 7 can be loosened from side wall 2. Now lever arm 10 can be pulled from bearing neck 4. Then the bearing 5 is freely accessible for the purpose of replacement. During this time, the adhesive transfer roller supports itself on side wall 2 in the area of hole 11.

The opposite end of the adhesive transfer roller 1 is mounted with its bearing neck 12 in the bearing 5 in lever arm 6, whereby lever arm 6 is mounted in a known way on the inside on side wall 2. Bearing neck 12 is connected to adhesive transfer roller 1 on the face side and coaxially with screw 13. For the purpose of replacing bearing 5, first the screw 13 is removed. After the Seeger circlip 16 is removed, a screw with larger diameter, which is not shown, is screwed into the thread 15 and after a few turns supports itself on the face side of the adhesive transfer roller 1 so that when this screw is turned further, the bearing neck 12 and the bearing 5 are pulled out of the lever arm 6. Both components can be removed from the outside through hole 14 without the adhesive transfer roller 1 having to be removed from the area between the side walls 2 of the machine frame.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. An adhesive application apparatus used to transfer adhesive to a sizing roller using an adhesive transfer roller, comprising:

a machine frame having first and second side walls spaced from one another;

an adhesive transfer roller extending between said side walls and mounted with bearings in first and second lever arms that are respectively mounted adjacent said side walls, said lever arms configured to move the adhesive transfer roller toward and away from the sizing roller and mounted so as to be rotatable in the machine frame;

said lever arm bearings being accessible from outside of the machine frame side walls such that said bearings can be replaced while said adhesive transfer roller remains in position between said side walls.

2. The adhesive application apparatus as set forth in claim 1, wherein the adhesive transfer roller is mounted in one of the lever arms by a bearing neck that is fastened on at least one end of said transfer roller so as to be removable therefrom.

3. The adhesive application apparatus as set forth in claim 2, wherein said neck is fastened on the end of the adhesive transfer roller with a screw.

4. The adhesive application apparatus as set forth in claim 1, wherein a first end of said adhesive transfer roller has a bearing neck that extends through an opening in said first side wall to project outside said first side wall, a drive gear being mounted on said first end, and said first lever arm being positioned between said drive gear and said first side wall.

5. The adhesive application apparatus as set forth in claim 4, wherein said first lever arm is secured to said first side wall by a bearing pin that extends generally parallel with said bearing neck.

6. The adhesive application apparatus as set forth in claim 5, wherein upon removal of said drive gear and said bearing pin, said first lever arm is configured to be pulled from said bearing neck to provide access to said lever arm bearings while said transfer roller is supported by said first side wall in an area of said opening.

7. The adhesive application apparatus as set forth in claim 4, wherein a second end of said adhesive transfer roller has a further bearing neck that is mounted within said second lever arm with bearings, said second lever arm being mounted on an inside of said second side wall.

8. The adhesive application apparatus as set forth in claim 7, wherein said second side wall has an opening through which said further bearing neck and bearings can be pulled out of said second lever arm from the outside of said machine frame while said second lever arm remains secured to said second side wall.

9. An adhesive application apparatus used to transfer adhesive to a sizing roller using an adhesive transfer roller, comprising:

a machine frame having first and second side walls spaced from one another;

an adhesive transfer roller extending between said side walls and mounted with bearings in first and second lever arms, said lever arms configured to move the adhesive transfer roller toward and away from the sizing roller and mounted so as to be rotatable in the machine frame;

said first lever arm being mounted outside said first side wall and said second lever arm being mounted inside said second side wall, said bearings in both lever arms being accessible from outside of the side walls such that said bearings can be replaced while said adhesive transfer roller remains in position between said side walls.

10. The adhesive application apparatus as set forth in claim 9, wherein the adhesive transfer roller is mounted in one of the lever arms by a bearing neck that is fastened on at least one end of said transfer roller so as to be removable therefrom.

11. The adhesive application apparatus as set forth in claim 10, wherein said neck is fastened on the end of the adhesive transfer roller with a screw.

12. The adhesive application apparatus as set forth in claim 9, wherein a first end of said adhesive transfer roller has a bearing neck that extends through an opening in said first side wall to project outside said first side wall, a drive gear being mounted on said first end, and said first lever arm being positioned between said drive gear and said first side wall.

13. The adhesive application apparatus as set forth in claim 12, wherein said first lever arm is secured to said first side wall by a bearing pin that extends generally parallel with said bearing neck.

14. The adhesive application apparatus as set forth in claim 13, wherein upon removal of said drive gear and said bearing pin, said first lever arm is configured to be pulled from said bearing neck to provide access to said lever arm bearings while said transfer roller is supported by said first side wall in an area of said opening.

15. The adhesive application apparatus as set forth in claim 10, wherein a second end of said adhesive transfer roller has a further bearing neck that is mounted within said second lever arm with bearings.

16. The adhesive application apparatus as set forth in claim 15, wherein said second side wall has an opening through which said further bearing neck and bearings can be pulled out of said second lever arm from the outside of said machine frame while said second lever arm remains secured to said second side wall.

* * * * *